United States Patent [19]

Gustafsson

[11] 4,371,324

[45] Feb. 1, 1983

[54] HELICAL GEAR MACHINE WITH IMPROVED HIGH PRESSURE PORT

[75] Inventor: Berth U. Gustafsson, Österskär, Sweden

[73] Assignee: AB Bonnierforetagen, Sweden

[21] Appl. No.: 195,016

[22] PCT Filed: Sep. 6, 1979

[86] PCT No.: PCT/SE79/00182

§ 371 Date: May 6, 1980

§ 102(e) Date: May 2, 1980

[87] PCT Pub. No.: WO80/00592

PCT Pub. Date: Apr. 3, 1980

[30] Foreign Application Priority Data

Sep. 6, 1978 [SE] Sweden ..... 7809394

[51] Int. Cl.[3] ..... F01C 1/16; F01C 21/12; F04C 2/16; F04C 18/16

[52] U.S. Cl. ..... 418/201

[58] Field of Search ..... 418/197, 201, 203, 202

[56] References Cited

U.S. PATENT DOCUMENTS

| | | | |
|---|---|---|---|
| 2,266,820 | 12/1941 | Smith | 418/201 |
| 2,462,924 | 3/1949 | Ungar | 418/201 |
| 2,623,469 | 12/1952 | Gray | 418/201 |
| 3,527,548 | 9/1970 | Kocher et al. | 418/201 |

FOREIGN PATENT DOCUMENTS

| | | | |
|---|---|---|---|
| 44608 | 9/1931 | Denmark | 418/202 |
| 1300867 | 12/1972 | United Kingdom | 418/201 |
| 269393 | 11/1971 | U.S.S.R. | 418/201 |

*Primary Examiner*—John J. Vrablik

*Attorney, Agent, or Firm*—Burns, Doane, Swecker & Mathis

[57] ABSTRACT

A gear machine comprising two helical gears running in mesh with each other, a first sealing body coming against one end surface of the gear pair, a fluid port in the first sealing body and a second sealing body coming against the outside circles (K) of the gears, at least at one gear meshing zone, is improved in that the tooth tops of the gears are adapted for sealing against the tooth bottoms of the gears in a plane (P) through the axes of the gears, the coacting teeth of the gears thus mutually seal along the whole of the pitch point line, and that the orifice of the port facing the gears substantially comprises a zone including the union of surfaces each defined by the outside and root circles (K and L, respectively) of the respective gear between the axis plane (P) and a gear radius (R) forming an angle ($\alpha$) with the axis plane (P), said angle ($\alpha$) at most attaining $B \times (1/R) \times$ tangent $\beta$, where B is the width of the gear-wheel pair, R is the outside circle radius of the respective gear, and $\beta$ is the helix angle of the gears, the angle between the axis plane and the gear radius being less than $2\pi$. If the angle ($\alpha$) is substantially equal to $B \times (1/R) \times$ tangent $\beta$, the machine is useful as a hydraulic pump. If the angle ($\alpha$) is less than $B \times (1/R) \times$ tangent $\beta$, the machine is useful as a precompressing compressor.

6 Claims, 4 Drawing Figures

HELICAL GEAR MACHINE WITH IMPROVED HIGH PRESSURE PORT

TECHNICAL FIELD

The invention relates to a gear machine comprising two helical gears running in mesh with each other, a first sealing body coming against one end surface of the gear pair, a fluid port in the first sealing body and a second sealing body coming against the outside circles of the gears, at least at one gear meshing zone.

BACKGROUND ART

Gear pumps usually comprise two gears running in mesh with each other and arranged in a housing coming sealingly against the gears except at the gear meshing zones, the pump inlet and outlet being placed at the respective gear meshing zone.

A disadvantage with such pumps is that they deliver a pulsating flow. Furthermore, such pumps have not been able to be modified for use as supercharging compressors.

Screw pumps can be used to avoid the drawbacks just mentioned. Screw pumps can comprise two screws running in mesh with each other, the screw pair being radially, sealingly surrounded by a housing so that the pumped liquid flows "axially", i.e. along the "tooth spaces" radially sealed by the housing. The "teeth" of the screws usually extend more than one revolution round the screw body so that each "tooth" always has (for the whole of the screw revolution) at least one, and usually two, points of intermesh with its associated "tooth space".

Such screw machines are expensive to produce and do not provide complete sealing between suction and pressure sides. The high cost of the screw machine is, i.a. dependent on the difficulty of manufacturing the screw, and that the screws are usually made with different profiles.

Screw machines can be modified so that they function as supercharging compressors, e.g. by the screws being formed with diminishing pitch towards the outlet (so-called Lysholm compressors). It will however be appreciated that such modification further increases the cost of the screw machine, added to which it is usually necessary to arrange external synchronisation of the screws.

OBJECT OF THE INVENTION

One object of the invention is therefore to provide a simple gear machine comprising gears which can be produced with simple conventional gear manufacturing techniques, and thus at relatively low cost, but in spite of which have the advantages of providing substantially uniform flow, be modified simply to supercharging compressors and do not require any external synchronisation (i.e. one gear can drive the other in practice).

SUMMARY OF THE INVENTION

In accordance with the invention, this object is achieved with a machine comprises two helical gears running in mesh with each other, a first sealing body coming against one end surface of the gear pair, a fluid port in the first sealing body and a second sealing body coming against the outside diameter circles of the gears, at least at one gear meshing zone, the machine being substantially distinguished in that the tooth tops of the gears are adapted for sealing against the tooth bottoms of the gears in the plane through the axes of the gears, and that the port orifice towards the gears substantially comprises an area defined by the union of surfaces each defined by the respective tooth top circles and tooth bottom circles of the respective gear, between the axis plane and a gear radius forming an angle to the axis plane which at most attains $B \times (1/R) \times \text{tangent } \beta$, where B is the width of the gear pair, R is the outside circle radius of the respective gear, and $\beta$ is the helix angle of the gears. Said angle of the gear radius to the axis plane is less than $2\pi$. The helix angle $\beta$ can be selected wth consideration to axial reaction forces and meshing friction. Each tooth preferably only extends round a portion of the circumference of the gear, e.g. about 60°. An ordinary helix angle can thus be utilized, e.g. $\beta = 30°$, and the gear width B (the axial length of the gears) can be adapted to suit the gear diameter, e.g. so that the width will be substantially equal to the diameter of the gear.

If the machine is to be used as a hydraulic pump, or a hydraulic motor, the angle between the gear radius and the plane P is substantially $= B \times (1/R) \times \text{tangent } \beta$. If the machine is to be used as a compressor, the angle between the gear radius and the axis plane is selected less than $\beta \times (1/R) \times \text{tangent } \beta$. The difference between the angle and $B = (1/R) \times \text{tangent } \beta$ defines the supercharging of the compressor.

The teeth of one wheel can be made with a tooth profile having the flank or flanks continuously merging into a round land, this tooth profile then being allowed to generate a corresponding profile on the other gear. There is thus theoretically obtained an unbroken sealing line between the gears in the axis plane thereof. The tooth profiles of the gears can correspond to each other so that the gears can be mutually the same.

The invention can naturally be applied to a gear machine of the planet gear type, so that one of the gears (the sun wheel) coacts with a plurality of gears (planet gears), a pumping or compressing arrangement of the type in accordance with the invention being obtained at each tooth intermesh.

The helical gear utilized in the inventive machine can be made with an evolvent tooth shape as basic shape, but it will be appreciated that it is possible to use other tooth shapes as well, although a primary requirement is that a tooth space in the axis plane is substantially entirely sealed axially by a coating tooth.

BRIEF DESCRIPTION OF DRAWINGS

The invention will now be described in detail in the form of an example, while referrring to the accompanying drawing.

DETAILED DESCRIPTION OF THE PREFERRED EMBODIMENT

Figure 1:
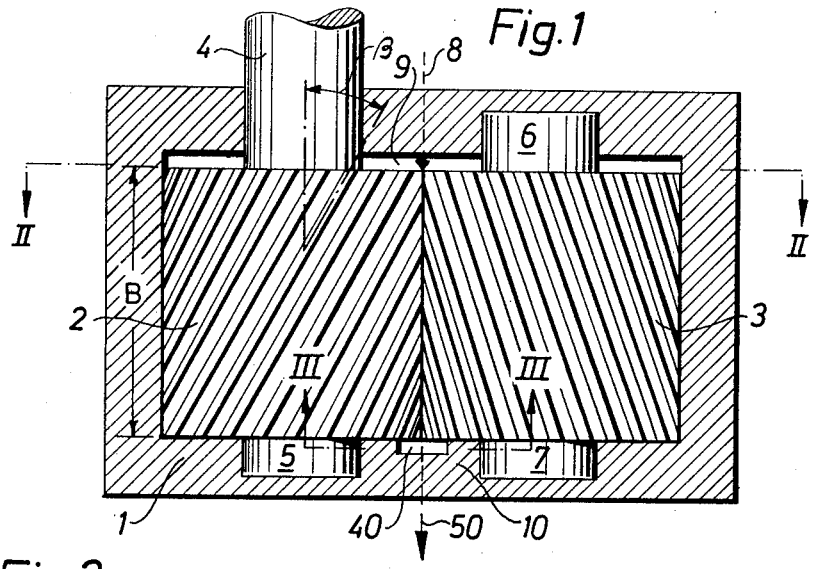
FIG. 1 is a section of a machine in accordance with the invention.

With reference to FIG. 1, a housing 1 includes two gears 2 and 3 which are mounted for running in mesh with each other. The gearwheel 2 is driven by means of an ingoing shaft 4 which is journalled similarly to an associated journal 5 in the housing 1. The gear 3 is journalled in the housing 1 by means of journals 6 and 7. If the machine in FIG. 1 is to be used as a compressor, fluid can be supplied in a suitable mode (e.g. via a bore through the housing wall), as indicated by the arrow 8, to a space 9 at the meshing zone of the gears 2, 3.

The lower wall 10 of the housing 1 in FIG. 1 engages substantially sealingly against the end surfaces of the gears 2, 3.

Figure 2:
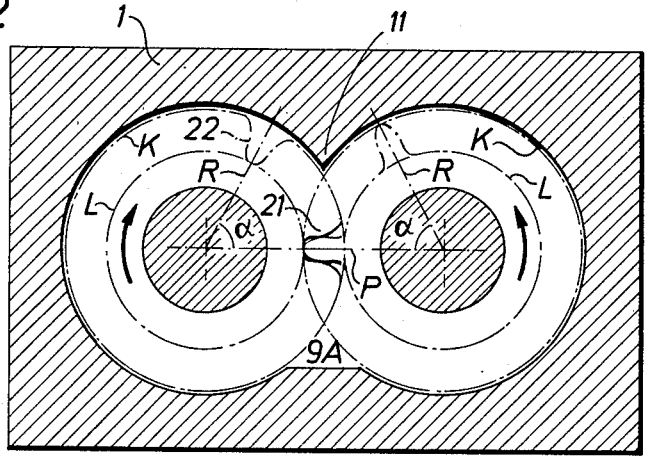
FIG. 2 is a section taken along the line II—II in FIG. 1.

When the machine according to FIG. 1 is to be used as a hydraulic pump or compressor, the gears 2, 3 rotate in the directions indicated in FIG. 2. The gears are helical, with a helix angle of about 30°, which means that if the gear width B (the axial length of the gears) is approximately equal to the gear diameter, the forward and rear ends of a gear tooth or space are separated by an angle $\alpha$ (see FIG. 2) of about 60°. As expressed in radians, the angle $\alpha$ is defined by the expression $B \times (1/R) \times \text{tangent } \beta$, where B is the width of the gear pair, R is the outside circle radius of the respective gear and $\beta$ is the helix angle of the gears.

The upper part 11 of the housing in FIG. 2 comes against the gear lands right down to the meshing zone. Only one tooth space with a tooth coacting therewith on the gears 3 and 2, respectively, is indicated in FIG. 2.

Figure 3:
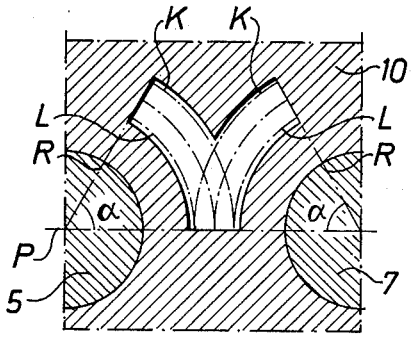
FIG. 3 is a partial section taken along the line III—III in FIG. 1.

In the position shown in FIG. 2, the end 21 of the tooth space at the suction gap 9 is situated in the axis plane P and is substantially entirely filled by the tooth coacting with the gear 2. The other end 22 of the tooth space at the housing end wall 10 is then at an angular distance $\alpha$ from the plane P. The end 22 of the tooth space is then substantially sealed against the housing end wall 10. An outlet port 40 is arranged in the end wall 10. The port 40 is defined by the axis plane P, the outside circles K and root circles L of the gears, and the gear radii R forming an angle $\alpha$ (see FIG. 3) to the axis plane. If the gears are now rotated further from the position shown in FIG. 2, the tooth end 22 will communicate with the port 40 while the tooth space is kept sealed longitudinally by means of the coacting tooth on the gear 2. This means that the contents of the tooth space 22 will be pressed out along the tooth space and into the port 40, from which the fluid can depart (e.g. by means of a bore) as indicated by the arrow 50 in FIG. 1.

It will be appreciated that the critical boundaries of the port 40 are formed by the axis plane P and the radii R at the angular distance $\alpha$ therefrom. The remaining defining lines of the port can follow the circles K and L, but also have some other extension as long as it is arranged that the end 22 of the tooth space does not communicate with the suction side of the machine when the end 22 has passed the radius R.

Depending on the selected tooth profile and size, it can be suitable to place the upper arm boundaries of the Y-shaped port at an angular distance from the plane P which is somewhat less than the given angle $\alpha$, thus enabling communication through the tooth space between the suction and pressure sides of the pump to be avoided, and that squeezing the liquid in the tooth space is avoided before the end 22 of the tooth space is brought to communicate with the port 40. This small adjustment is within the scope of one skilled in the art to test theoretically and/or practically.

The suction side 9 of the machine can have a duct 9a extending parallel to the gear axes to ensure filling the tooth spaces on the suction side of the machine.

The suction side can alternatively be formed by a recess in the upper housing wall in FIG. 1, said recess thereby at least comprising the zone defined by the intersection of the outside circles of the gears 2, 3 while the housing wall otherwise seals against the ends of the gears.

The gears are suitably formed with an evolvent basic form, the top and bottom lands of the teeth being defined by continuous curves continuously merging with the flanks so that the top lands of one gear seal against the bottom lands of the other in the axis plane. The gears 2 and 3 suitably have the same tooth profile. The continuous curves can, for example, consist of circular arcs or parabalic sections.

Figure 4:
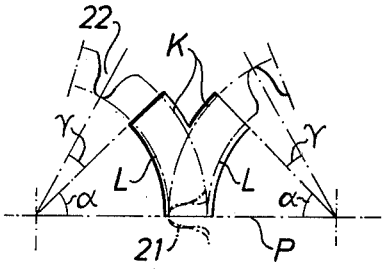
FIG. 4 is a view corresponding to that in FIG. 3 and illustrating the machine of FIG. 1 as modified to a compressor or expansion motor.

The gear mesh in the axis plane P will thus ensure an axial seal of all the tooth spaces opening out into the port 40, while the housing wall 10 axially seals all the tooth spaces not opening out into the port 10. FIG. 4 illustrates how the port 40 can be modified to convert the machine to a compressor in accordance with FIGS. 1–3. The modification made is that the upper branch portions of the port 40 are caused to lie along a radius having an angle $\alpha$ to the axis plane P, which is less than $B \times (1/R) \times \text{tangent } \beta$ by the angular dimension $\gamma$, the angular dimension $\gamma$ defining the supercharging or precompression given to the fluid before the tooth space is brought into communication with the port 40.

The principles, preferred embodiments and mode of operation of the present invention have been described in the foregoing specification. However, the invention which is intended to be protected is not be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. An axial flow gear machine comprising two helical gears running in mesh with each other, a first sealing body arranged against one end surface of the gear pair, a fluid port in the first sealing body, a second sealing body arranged against outside circles of the gears at least at one gear meshing zone, tooth profiles of the two gears being alike with each tooth profile including a tooth flank which continuously merges into a rounded top and a rounded bottom, each tooth extending less than one revolution around the respective gear, the tooth tops of one of the gears being adapted for sealing against the tooth bottoms of the other of said gears in a plane through the axes of the gears, the coacting teeth of the gears mutually sealing along the whole of the pitch point line, an orifice of the port facing the gears substantially comprises a zone defined by the union of surfaces each defined by the outside circle and a root circle of the respective gear teeth between the axes plane and a gear radius forming an angle ($\alpha$) with the axes plane, said angle ($\alpha$) at most attaining $B \times (1/R) \times \text{tangent } \beta$, where B is the width of the gear pair, R is the outside circle radius of the respective gear, and $\beta$ is the helix angle of the gears, the angle ($\alpha$) between the axes plane and the gear radius being less than $2\pi$, and the helix angle being between 20° and 45°.

2. The machine as claimed in claim 1, wherein the angle ($\alpha$) between the gear radius and the axes plane is substantially equal to $B \times (1/R) \times$ tangent $\beta$ such that the machine is adapted for use as a hydraulic pump.

3. The machine as claimed in claim 1, wherein the angle ($\alpha$) between the axes plane and the gear radius (R) is less than $B \times (1/R) \times$ tangent $\beta$ such that the machine is adapted for use as a supercharging compressor.

4. The machine as claimed in claim 1, wherein each tooth extends less than half a revolution around the respective gear.

5. The machine as claimed in claim 1, wherein the helix angle ($\beta$) is about 30°.

6. The machine as claimed in claim 1, wherein the gears are mutually alike.

* * * * *